US011288994B2

(12) United States Patent
Wang et al.

(10) Patent No.: US 11,288,994 B2
(45) Date of Patent: Mar. 29, 2022

(54) SOURCE DRIVER AND OPERATION METHOD THEREOF

(71) Applicant: Novatek Microelectronics Corp., Hsinchu (TW)

(72) Inventors: Ying-Hsiang Wang, New Taipei (TW); Chia-Lun Chang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/117,121

(22) Filed: Dec. 10, 2020

(65) Prior Publication Data

US 2022/0013052 A1 Jan. 13, 2022

Related U.S. Application Data

(60) Provisional application No. 63/050,079, filed on Jul. 9, 2020.

(51) Int. Cl.
*G09G 3/20* (2006.01)

(52) U.S. Cl.
CPC ..... *G09G 3/20* (2013.01); *G09G 2310/027* (2013.01); *G09G 2310/0291* (2013.01)

(58) Field of Classification Search
CPC ..... G09G 3/20; G09G 2310/027; G09G 2310/0291
See application file for complete search history.

(56) References Cited

U.S. PATENT DOCUMENTS 6,237,107 B1 * 5/2001 Williams ..... G06F 13/4072 713/503
2007/0091054 A1 * 4/2007 Lee ..... G09G 3/3688 345/100
2010/0097142 A1 * 4/2010 Liang ..... H03F 3/45475 330/277
2018/0374427 A1 * 12/2018 Kuei ..... G09G 3/3688

* cited by examiner

*Primary Examiner* — Muhammad N Edun
(74) *Attorney, Agent, or Firm* — JCIPRNET

(57) ABSTRACT

A source driver adapted to drive a display panel is provided. The source driver includes an output buffer and a slew rate adjustment circuit. An input terminal of the output buffer receives a driving voltage. An output terminal of the output buffer outputs an output signal adapted to drive the display panel. The slew rate adjustment circuit dynamically adjusts a slew rate of a rising edge of the output signal according to a first setting and dynamically adjusts a slew rate of a falling edge of the output signal according to a second setting independent of the first setting, such that the adjustment to the slew rate of the rising edge of the output signal is independent of the adjustment to the slew rate of the falling edge of the output signal.

21 Claims, 12 Drawing Sheets

SOURCE DRIVER AND OPERATION METHOD THEREOF

CROSS-REFERENCE TO RELATED APPLICATION

This application claims the priority benefit of U.S. provisional application Ser. No. 63/050,079, filed on Jul. 9, 2020. The entirety of the above-mentioned patent application is hereby incorporated by reference herein and made a part of this specification.

BACKGROUND

Technical Field

The disclosure relates to a display device, and particularly relates to a source driver and an operation method thereof.

Description of Related Art

A source driver is capable of driving a display panel to display an image. A problem that often occurs in output signals of the source driver is that output waveforms of source operational amplifiers (output buffers) of adjacent driving channels are not symmetrical. In general application, even if the output waveform of an odd-numbered driving channel (hereinafter ODD-CH) is asymmetrical to the output waveform of an even-numbered driving channel (hereinafter EVEN-CH), abnormal display of the display panel is hardly (or cannot be) recognized by the human eye as long as sufficient charging time is allowed.

SUMMARY

The disclosure provides a source driver and an operation method thereof, in which a slew rate of a rising edge and a slew rate of a falling edge are independently adjusted.

In an embodiment of the disclosure, the source driver is adapted to drive a display panel. The source driver includes a first output buffer and a first slew rate adjustment circuit. An input terminal of the first output buffer receives a first driving voltage. An output terminal of the first output buffer outputs a first output signal to drive the display panel. The first slew rate adjustment circuit dynamically adjusts a slew rate of a rising edge of the first output signal according to a first setting and to dynamically adjust a slew rate of a falling edge of the first output signal according to a second setting independent of the first setting.

In an embodiment of the disclosure, the operation method includes: receiving a first driving voltage by a first output buffer; outputting a first output signal adapted to drive a display panel by the first output buffer; and, by a first slew rate adjustment circuit, dynamically adjusting a slew rate of a rising edge of the first output signal according to a first setting, and dynamically adjusting a slew rate of a falling edge of the first output signal according to a second setting independent of the first setting.

Based on the above, the source driver and the operation method thereof according to embodiments of the disclosure may dynamically adjust the slew rates of the rising edge and the falling edge of the first output signal using different settings, such that the adjustment to the slew rate of the rising edge is independent of the adjustment to the slew rate of the falling edge. Therefore, in some embodiments, in the source driver, the output signals of different output buffers are symmetrical to each other.

To make the disclosure more comprehensible, several embodiments accompanied with drawings are described in detail as follows.

DESCRIPTION OF THE EMBODIMENTS

Figure 1:
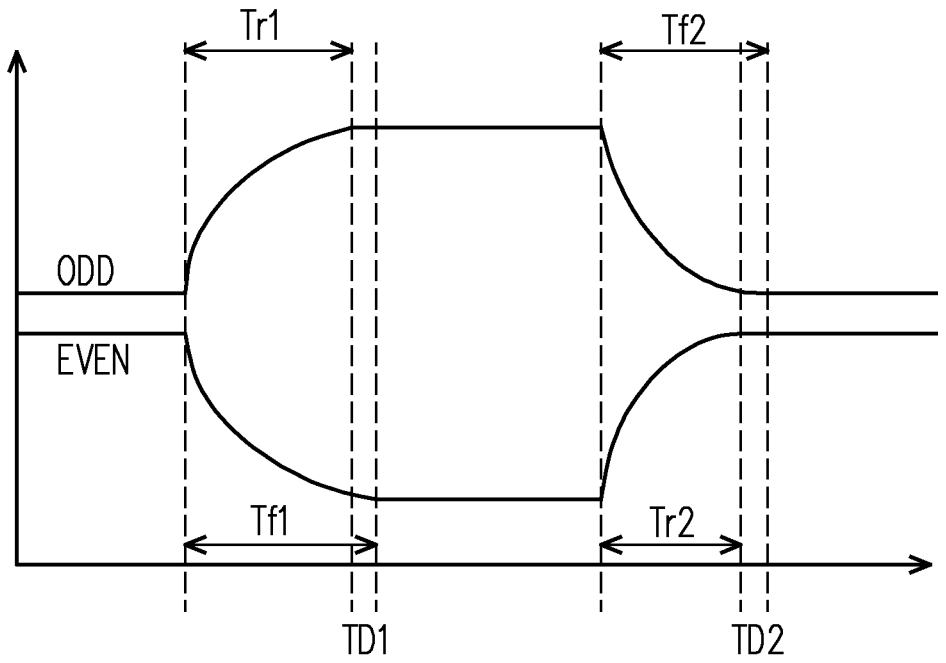
FIG. 1 is a schematic diagram of output waveforms of output buffers of adjacent driving channels.

The terms such as "first" and "second" mentioned throughout this specification (including the claims) are used to name elements, or for distinguishing different embodiments or scopes, instead of restricting the upper limit or the lower limit of the number of the elements, nor limiting the order of the elements. Moreover, wherever appropriate in the drawings and embodiments, elements/components/steps with the same reference numerals denote the same or similar parts. Elements/components/steps with the same reference numerals or names in different embodiments may be cross-referenced.

FIG. 1 is a schematic diagram of output waveforms of output buffers of adjacent driving channels. The waveforms shown in FIG. 1 show a common case of asymmetrical outputs of the output buffers. In FIG. 1, the vertical axis indicates voltage and the horizontal axis indicates time. Tr shown in FIG. 1 indicates a rising time of a driving signal (output signal) output by an output buffer, and Tf shown in FIG. 1 indicates a falling time of a driving signal. In the example shown in FIG. 1, a rising time Tr1 of an ODD-CH is unequal to (i.e., asymmetrical to) a falling time Tf1 of an EVEN-CH, and a falling time Tf2 of the ODD-CH is unequal to (i.e., asymmetrical to) a rising time Tr2 of the EVEN-CH. A time difference between the rising time Tr1 and the falling time Tf1 is denoted by TD1, and a time difference between the rising time Tr2 and the falling time Tf2 is denoted by TD2. The asymmetry of Tr (or asymmetry of Tf) mainly originates from asymmetry of devices of an output buffer (hereinafter ODD-OP) of the ODD-CH and an output buffer (hereinafter EVEN-OP) of the EVEN-CH and various bias mismatches. When an output signal of the ODD-OP is rising and an output signal of the EVEN-OP is falling, since charge and discharge paths controlled by transistors inside the output buffers are different, they are affected by different parasitic capacitors on two completely different paths. Even output stages of the output buffers have completely different driving abilities. Although the ODD-OP and the EVEN-OP can be made as symmetrical as possible in design, the asymmetry of Tr/Tf may occur under the influence of mobility, parasitic capacitors and threshold voltage (VTH) of NMOS/PMOS devices.

In order to solve the problem caused by the asymmetry of the slew rate of the source operational amplifier (output buffer), the ODD-OP and the EVEN-OP are separately biased. Bias control is performed on the ODD-CH and the EVEN-CH respectively by using two different sets of global control bits, so that the ODD-OP and the EVEN-OP can output different Tr/Tf respectively. As shown in FIG. 1, the rising time Tr1 of the ODD-OP is less than the falling time Tf1 of the EVEN-OP, while the falling time Tf2 of the ODD-OP is greater than the rising time Tr2 of the EVEN-OP. In order to enable the slew rate of the rising edge of an ODD-OP signal to be symmetrical to the slew rate of the falling edge of an EVEN-OP signal, different biases are applied to the ODD-OP and the EVEN-OP so as to reduce the slew rate of the ODD-OP and/or increase the slew rate of the EVEN-OP. However, reducing the slew rate of the ODD-OP may increase the falling time Tf2 of the ODD-OP, and increasing the slew rate of the EVEN-OP may reduce the rising time Tr2 of the EVEN-OP. As a result of the above operation, the slew rate of the falling edge of the ODD-OP signal and the slew rate of the rising edge of the EVEN-OP signal may become more asymmetric.

The following describes implementation examples in which the rising time Tr and the falling time Tf are independently adjusted with respect to an output buffer (for example, an operational amplifier) of arbitrary polarity. That is, an adjustment to a slew rate of a rising edge of an output signal may be independent of an adjustment to a slew rate of a falling edge of the output signal. In some embodiments, a slew rate adjustment circuit may make a judgment using a relationship between current sub-pixel data in a driving channel and next sub-pixel data that follows the current sub-pixel data. In some embodiments, a source driver may dynamically adjust the rising time Tr and the falling time Tf of an output buffer of each driving channel by operations such as global bias coarse adjustment and global bias fine adjustment. In some embodiments, an adjustment to a slew rate of an odd-numbered driving channel (hereinafter ODD-CH) may be independent of an adjustment to a slew rate of an even-numbered driving channel (hereinafter EVEN-CH).

Figure 2A:
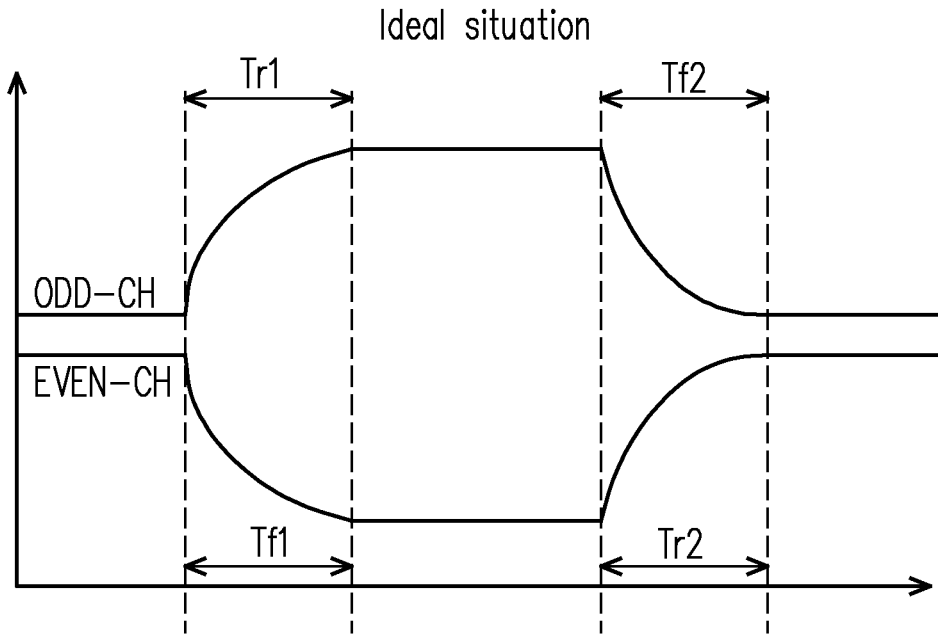
FIG. 2A to FIG. 2C are schematic diagrams of output waveforms of output buffers of adjacent driving channels according to different embodiments.
Figure 2B:
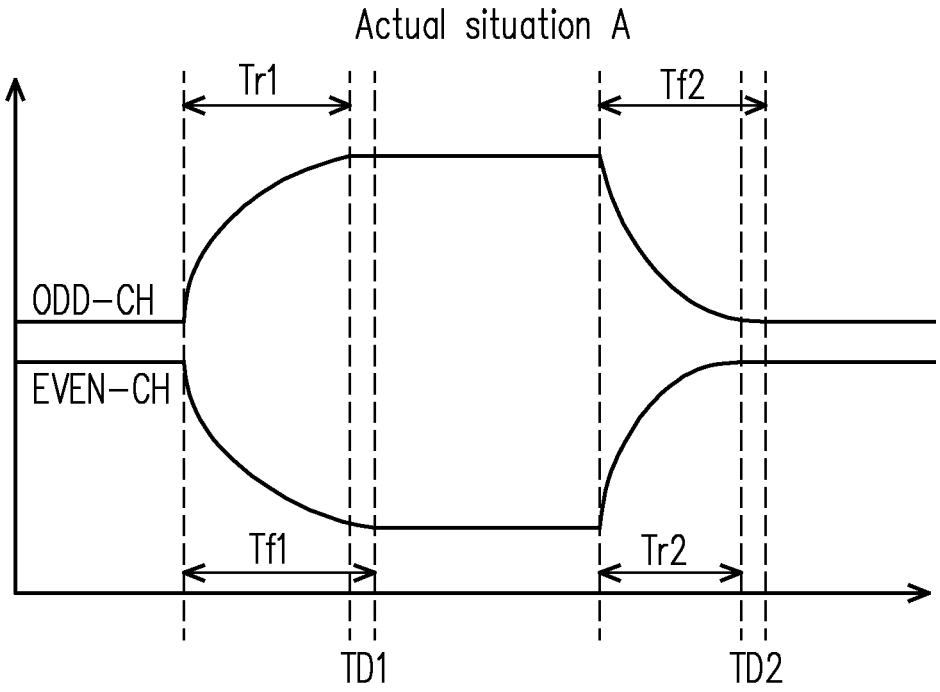
Figure 2C:
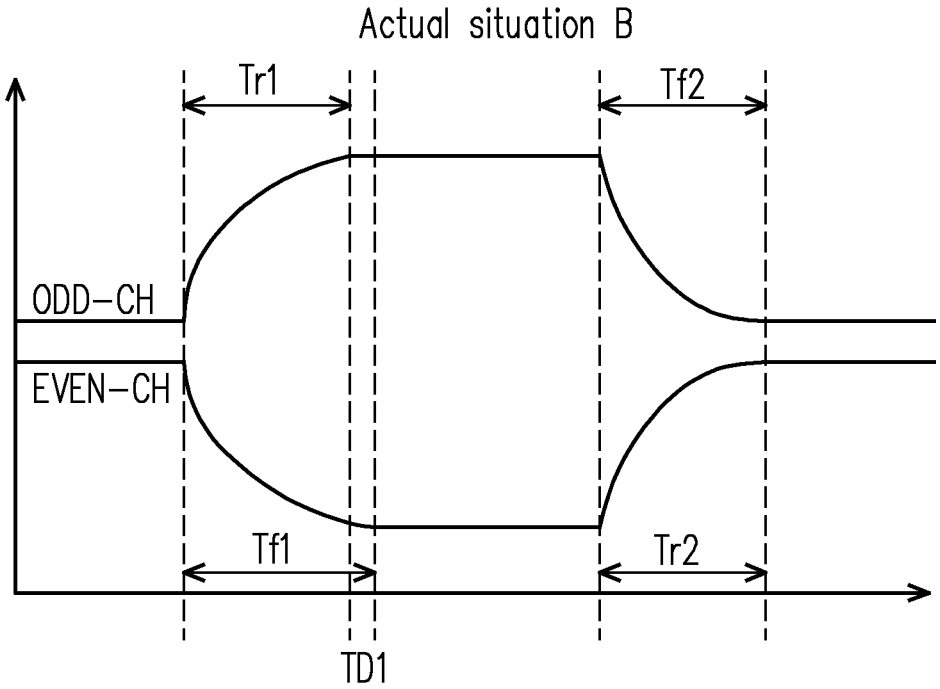

FIG. 2A to FIG. 2C are schematic diagrams of output waveforms of output buffers of adjacent driving channels according to different embodiments. In FIG. 2A to FIG. 2C, the vertical axis indicates voltage and the horizontal axis indicates time. In FIG. 2A to FIG. 2C, Tr indicates a rising time of an output signal of an output buffer, and Tf indicates a falling time of an output signal of an output buffer. FIG. 2A illustrates an ideal situation in which the rising time Tr of the output signal of the output buffer (hereinafter ODD-OP) of the ODD-CH and the falling time Tf of the output signal of the output buffer (hereinafter EVEN-OP) of the EVEN-CH are symmetrical to each other. As shown in FIG. 2A, a rising time Tr1 of the ODD-CH is equal to a falling time Tf1 of the EVEN-CH, and a falling time Tf2 of the ODD-CH is equal to a rising time Tr2 of the EVEN-CH.

FIG. 2B illustrates an actual situation A, and FIG. 2C illustrates another actual situation B. In the actual situation A shown in FIG. 2B, the rising time Tr1 of the ODD-CH is less than (i.e., asymmetrical to) the falling time Tf1 of the EVEN-CH, and the falling time Tf2 of the ODD-CH is greater than (i.e., asymmetrical to) the rising time Tr2 of the EVEN-CH. A time difference between the rising time Tr1 and the falling time Tf1 is denoted by TD1, and a time difference between the rising time Tr2 and the falling time Tf2 is denoted by TD2. In the actual situation B shown in FIG. 2C, the rising time Tr1 of the ODD-CH is less than (i.e., asymmetrical to) the falling time Tf1 of the EVEN-CH, and the falling time Tf2 of the ODD-CH is equal to (i.e., symmetrical to) the rising time Tr2 of the EVEN-CH. In each of the following embodiments, it is possible to adjust the rising time Tr and the falling time Tf individually for each driving channel. Therefore, whether the asymmetry is that shown in the actual situation A of FIG. 2B or that shown in the actual situation B of FIG. 2C, the four times (Tr1, Tr2, Tf1, and Tf2) can be adjusted to a balanced condition, that is, the rising time Tr1 is equal to (i.e., symmetrical to) the falling time Tf1, and the falling time Tf2 is also equal to (i.e., symmetrical to) the rising time Tr2. Therefore, in each of the following embodiments, a current recovery rate may be increased, thereby reducing thermal energy consumption as well as eliminating electromagnetic interference (EMI) and touch panel noise or the like.

Figure 3:
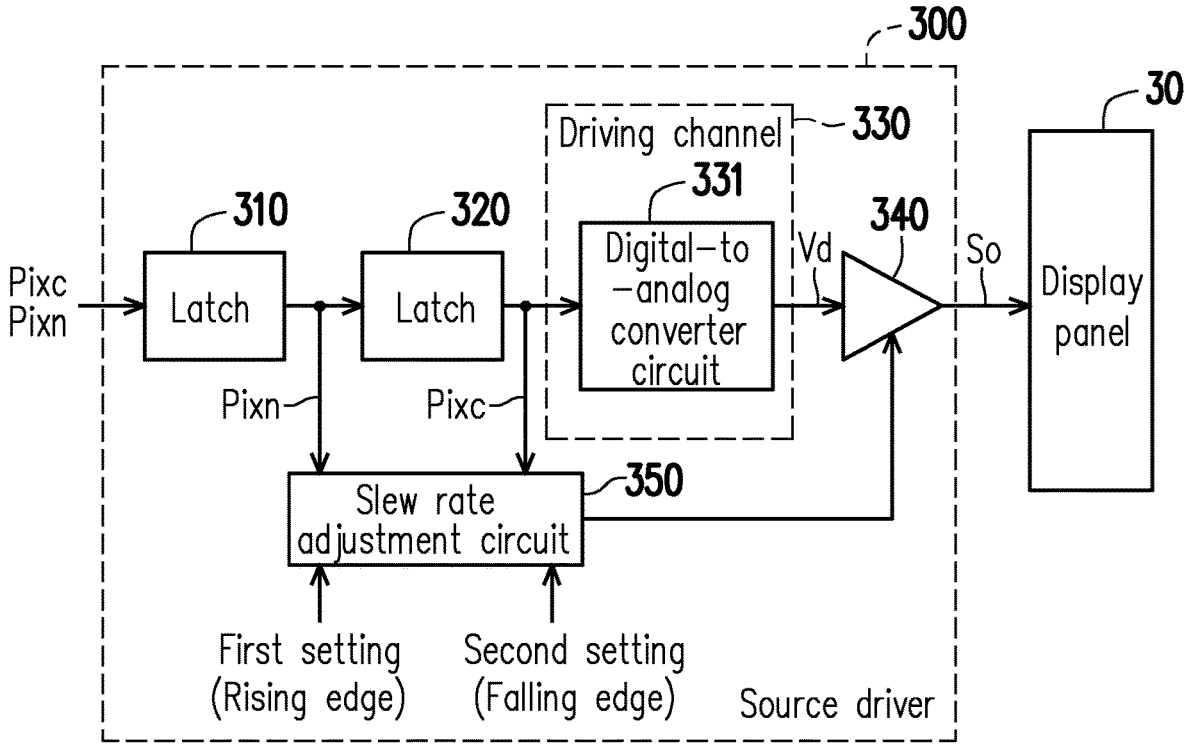
FIG. 3 is a schematic circuit block diagram of a source driver according to an embodiment of the disclosure.

FIG. 3 is a schematic circuit block diagram of a source driver 300 according to an embodiment of the disclosure. The source driver 300 is adapted to drive a display panel 30. The source driver 300 shown in FIG. 3 includes a latch 310, a latch 320, a driving channel 330, an output buffer 340, and a slew rate adjustment circuit 350. The driving channel 330 at least includes a digital-to-analog converter circuit 331. An output terminal of the latch 310 is coupled to an input terminal of the latch 320. An output terminal of the latch 320 is coupled to an input terminal of the digital-to-analog converter circuit 331. An output terminal of the digital-to-analog converter circuit 331 is coupled to an input terminal of the output buffer 340. An output terminal of the output buffer 340 is adapted to be coupled to a data line corresponding thereto among multiple data lines (source lines) of the display panel 30.

Figure 4:
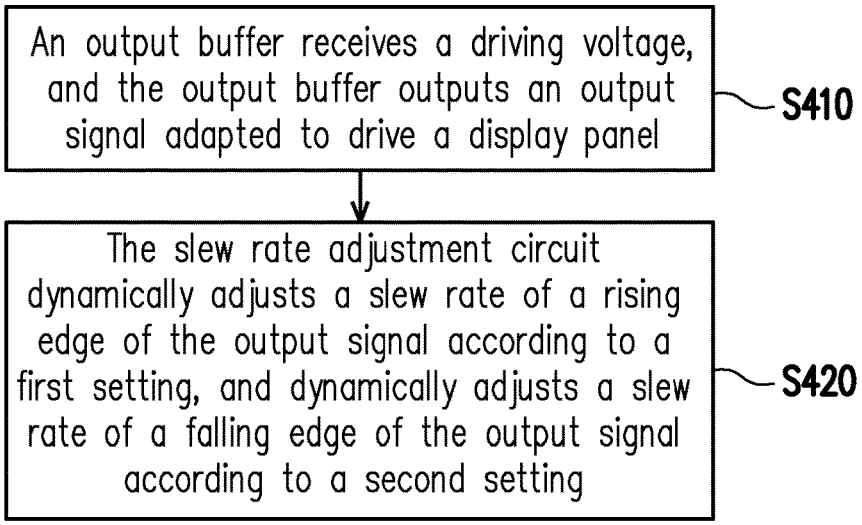
FIG. 4 is a schematic flowchart of an operation method of a source driver according to an embodiment of the disclosure.

FIG. 4 is a schematic flowchart of an operation method of a source driver according to an embodiment of the disclosure. Please refer to FIG. 3 and FIG. 4. An input terminal of the latch 310 sequentially receives current sub-pixel data Pixc and next sub-pixel data Pixn. The input terminal of the latch 320 is coupled to the output terminal of the latch 310 to receive the next sub-pixel data Pixn. The input terminal of the digital-to-analog converter circuit 331 of the driving channel 330 is coupled to the output terminal of the latch 320 to receive the current sub-pixel data Pixc. The output terminal of the digital-to-analog converter circuit 331 serves as an output terminal of the driving channel 330. The driving channel 330 may convert the current sub-pixel data Pixc into a driving voltage Vd.

The output terminal of the driving channel 330 is coupled to the input terminal of the output buffer 340 to provide the driving voltage Vd. In step S410, the input terminal of the output buffer 340 receives the driving voltage Vd output by the driving channel 330, and the output terminal of the output buffer 340 may output an output signal So adapted to drive the display panel 30. In step S420, the slew rate adjustment circuit 350 may dynamically adjust a slew rate of a rising edge of the output signal So according to a first setting and may dynamically adjust a slew rate of a falling edge of the output signal So according to a second setting independent of the first setting, such that the adjustment to the slew rate of the rising edge of the output signal So is independent of the adjustment to the slew rate of the falling edge of the output signal So.

The first setting and the second setting may be two configuration parameters (for example, a rising time parameter and a falling time parameter) independent of each other. These two configuration parameters may be preset according to actual application scenarios. Other control circuits (for example, a timing controller, an application processor, or other processing circuit, not shown) may dynamically provide these two configuration parameters to (or set them in) the slew rate adjustment circuit 350. Since the two configuration parameters are adjusted (or set) independently of each other, the adjustment to the slew rate (for example, the rising time Tr1) of the rising edge of the output signal So is independent of the adjustment to the slew rate (for example, the falling time Tf2) of the falling edge of the output signal So.

The number of the slew rate adjustment circuit 350 may be determined according to actual condition. For example, in some embodiments, the output buffer of each driving channel of the source driver 300 may include a dedicated slew rate adjustment circuit 350. In other embodiments, all the driving channels of the source driver 300 may be divided into multiple channel groups, and the output buffers of each of the channel groups may include one slew rate adjustment circuit 350. In still other embodiments, the output buffers of all the driving channels of the source driver 300 may share one slew rate adjustment circuit 350.

The slew rate adjustment circuit 350 may judge whether a slew rate to be adjusted is at the rising edge or the falling edge of the output signal So. The implementation of the slew rate adjustment circuit 350 depends on actual condition. For example, in embodiments other than that shown in FIG. 3, the slew rate adjustment circuit 350 may not be coupled to the latch 310 and the latch 320. In such an implementation, a system (for example, a timing controller, an application processor, or other pre-stage circuit, not shown) may notify the slew rate adjustment circuit 350 that the gray level of the current sub-pixel data Pixc will increase or decrease. Accordingly, the slew rate adjustment circuit 350 is able to know whether the output signal So will have a rising edge or a falling edge, that is, the slew rate adjustment circuit 350 is able to judge whether the slew rate to be adjusted is at the rising edge or the falling edge of the output signal So. Alternatively, the implementation of the slew rate adjustment circuit 350 may be as described in the embodiment shown in FIG. 3. The slew rate adjustment circuit 350 may perform the above judgment in accordance with a relationship between the current sub-pixel data Pixc and the next sub-pixel data Pixn that follows the current sub-pixel data Pixc.

In the embodiment shown in FIG. 3, one input terminal of the slew rate adjustment circuit 350 is coupled to the output terminal of the latch 310 to receive the next sub-pixel data Pixn. Another input terminal of the slew rate adjustment circuit 350 is coupled to the output terminal of the latch 320 to receive the current sub-pixel data Pixc. The slew rate adjustment circuit 350 may control the output buffer 340 based on the current sub-pixel data Pixc and the next sub-pixel data Pixn, so as to adjust the slew rate of the output signal So. In detail, based on the current sub-pixel data Pixc and the next sub-pixel data Pixn, the slew rate adjustment circuit 350 is able to know whether the gray level of the current sub-pixel data Pixc will increase or decrease. Therefore, the slew rate adjustment circuit 350 is able to know whether the output signal So will have a rising edge or a falling edge. When the slew rate adjustment circuit 350 determines that the output signal So will have a rising edge, the slew rate adjustment circuit 350 may dynamically adjust the slew rate of the rising edge of the output signal So using the first setting. When the slew rate adjustment circuit 350 determines that the output signal So will have a falling edge, the slew rate adjustment circuit 350 may dynamically adjust the slew rate of the falling edge of the output signal So using the second setting (which is independent of the first setting).

Based on the dynamic adjustment by the slew rate adjustment circuit 350, that is, based on the first setting and the second setting, an adjustment direction of the slew rate of the rising edge of the output signal So may be different from an adjustment direction of the slew rate of the falling edge of the output signal So. Taking the actual situation A shown in FIG. 2B as an example, the slew rate adjustment circuit 350 may reduce the slew rate (that is, increase the rising time Tr1) of the rising edge of the output signal So of the ODD-CH and may increase the slew rate (that is, reduce the falling time Tf2) of the falling edge of the output signal So of the ODD-CH. That is, the adjustment direction of the slew rate of the rising edge of the output signal So is "the direction of increasing", and the adjustment direction of the slew rate of the falling edge of the output signal So is "the direction of decreasing". Taking the actual situation B shown in FIG. 2C as an example, the slew rate adjustment circuit 350 may reduce the slew rate (that is, increase the rising time Tr1) of the rising edge of the output signal So of the ODD-CH and may make no adjustment to the slew rate of the falling edge of the output signal So of the ODD-CH. The source driver of the present embodiment may dynamically adjust the slew rates of the rising edge and the falling edge of the output signal So using different settings, such that the adjustment to the slew rate of the rising edge is independent of the adjustment to the slew rate of the falling edge. Therefore, the source driver 300 makes it possible that the output signals of different output buffers are symmetrical to each other.

Figure 5:
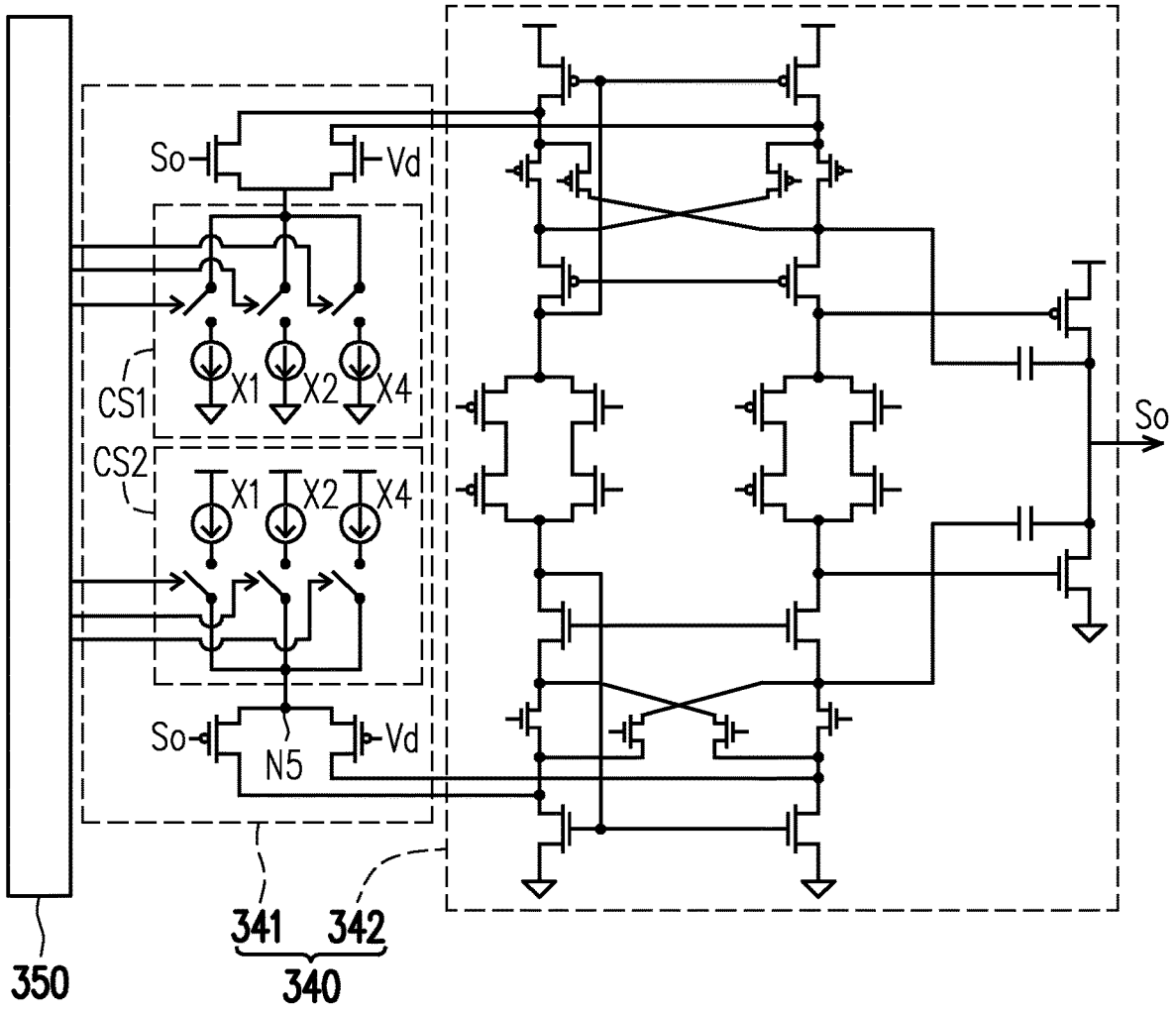
FIG. 5 is a schematic circuit diagram illustrating an output buffer shown in FIG. 3 according to an embodiment of the disclosure.

FIG. 5 is a schematic circuit diagram illustrating the output buffer 340 shown in FIG. 3 according to an embodiment of the disclosure. The output buffer 340 shown in FIG. 5 includes an input stage 341 and an output stage 342. The slew rate adjustment circuit 350 may adjust/set current source configurations of tail current sources CS1 and CS2 in the input stage 341. When the slew rate adjustment circuit 350 determines that no adjustment is to be made to the slew rate of the output signal So, the slew rate adjustment circuit 350 may select a double current source X2 of the tail current sources CS1 and CS2. When the slew rate adjustment circuit 350 determines that the slew rate of the output signal So needs to be increased, the slew rate adjustment circuit 350 may select a quadruple current source X4 of the tail current sources CS1 and CS2. When the slew rate adjustment circuit 350 determines that the slew rate of the output signal So needs to be reduced, the slew rate adjustment circuit 350 may select a single current source X1 of the tail current sources CS1 and CS2. Therefore, based on the adjustment/setting of the current source configuration of the input stage 341, the rising time Tr and the falling time Tf of the output buffer 340 can be adjusted independently.

Figure 6:
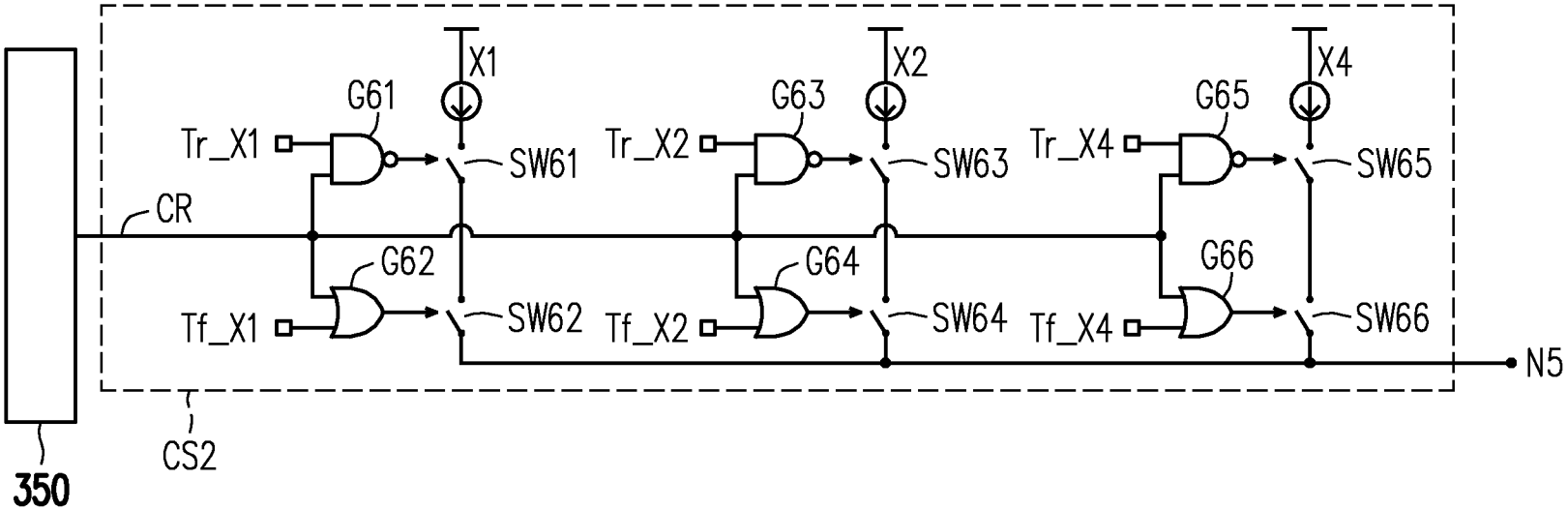
FIG. 6 is another schematic circuit diagram illustrating a tail current source in an input stage shown in FIG. 5 according to another embodiment of the disclosure.

FIG. 6 is another schematic circuit diagram illustrating the tail current source CS2 in the input stage 341 shown in FIG. 5 according to another embodiment of the disclosure. The tail current source CS1 in the input stage 341 shown in FIG. 5 may be understood by analogy with reference to the related description of the tail current source CS2. The tail current source CS2 shown in FIG. 6 includes the single current source X1, the double current source X2, the quadruple current source X4, a switch SW61, a switch SW62, a switch SW63, a switch SW64, a switch SW65, a switch SW66, a NAND gate G61, a NAND gate G63, a NAND gate G65, an OR gate G62, an OR gate G64 and an OR gate G66.

A first terminal of the switch SW61 is coupled to the current source X1. A first terminal of the switch SW62 is coupled to a second terminal of the switch SW61. A second terminal of the switch SW62 is coupled to a node N5 in the input stage 341 shown in FIG. 5. A first terminal of the switch SW63 is coupled to the current source X2. A first terminal of the switch SW64 is coupled to a second terminal of the switch SW63. A second terminal of the switch SW64 is coupled to the node N5. A first terminal of the switch SW65 is coupled to the current source X4. A first terminal of the switch SW66 is coupled to a second terminal of the switch SW65. A second terminal of the switch SW66 is coupled to the node N5. A first input terminal of the NAND gate G61 receives a first bit Tr_X1 of a rising edge slew rate parameter. An output terminal of the NAND gate G61 is coupled to a control terminal of the switch SW61. A first input terminal of the NAND gate G63 receives a second bit Tr_X2 of the rising edge slew rate parameter. An output terminal of the NAND gate G63 is coupled to a control terminal of the switch SW63. A first input terminal of the NAND gate G65 receives a third bit Tr_X4 of the rising edge slew rate parameter. An output terminal of the NAND gate G65 is coupled to a control terminal of the switch SW65. A first input terminal of the OR gate G62 receives a first bit Tf_X1 of a falling edge slew rate parameter. An output terminal of the OR gate G62 is coupled to a control terminal of the switch SW62. A first input terminal of the OR gate G64 receives a second bit Tf_X2 of the falling edge slew rate parameter. An output terminal of the OR gate G64 is coupled to a control terminal of the switch SW64. A first input terminal of the OR gate G66 receives a third bit Tf_X4 of the falling edge slew rate parameter. An output terminal of the OR gate G66 is coupled to a control terminal of the switch SW66.

The rising edge slew rate parameters Tr_X1 to Tr_X4 may be stored in one parameter register, and the falling edge slew rate parameters Tf_X1 to Tf_X4 may be stored in another parameter register. In some embodiments, the rising edge slew rate parameters Tr_X1 to Tr_X4 and the falling edge slew rate parameters Tf_X1 to Tf_X4 may be local parameters. In other embodiments, the rising edge slew rate parameters Tr_X1 to Tr_X4 and the falling edge slew rate parameters Tf_X1 to Tf_X4 may be global parameters. In some embodiments, the slew rate adjustment circuit 350 may provide the rising edge slew rate parameters Tr_X1 to Tr_X4 and the falling edge slew rate parameters Tf_X1 to Tf_X4 to the NAND gate G61, the NAND gate G63, the NAND gate G65, the OR gate G62, the OR gate G64 and the OR gate G66. In other embodiments, the rising edge slew rate parameters Tr_X1 to Tr_X4 and the falling edge slew rate parameters Tf_X1 to Tf_X4 may be provided by other circuits/elements (not shown).

The slew rate adjustment circuit 350 is coupled to a second input terminal of the NAND gate G61, a second input terminal of the NAND gate G63, a second input terminal of the NAND gate G65, a second input terminal of the OR gate G62, a second input terminal of the OR gate G64 and a second input terminal of the OR gate G66, so as to provide a comparison result CR of the current sub-pixel data Pixc and the next sub-pixel data Pixn. It is assumed herein that the comparison result CR with a high logic level indicates "the output signal So will have a rising edge," and the comparison result CR with a low logic level indicates "the output signal So will have a falling edge."

Figure 7:
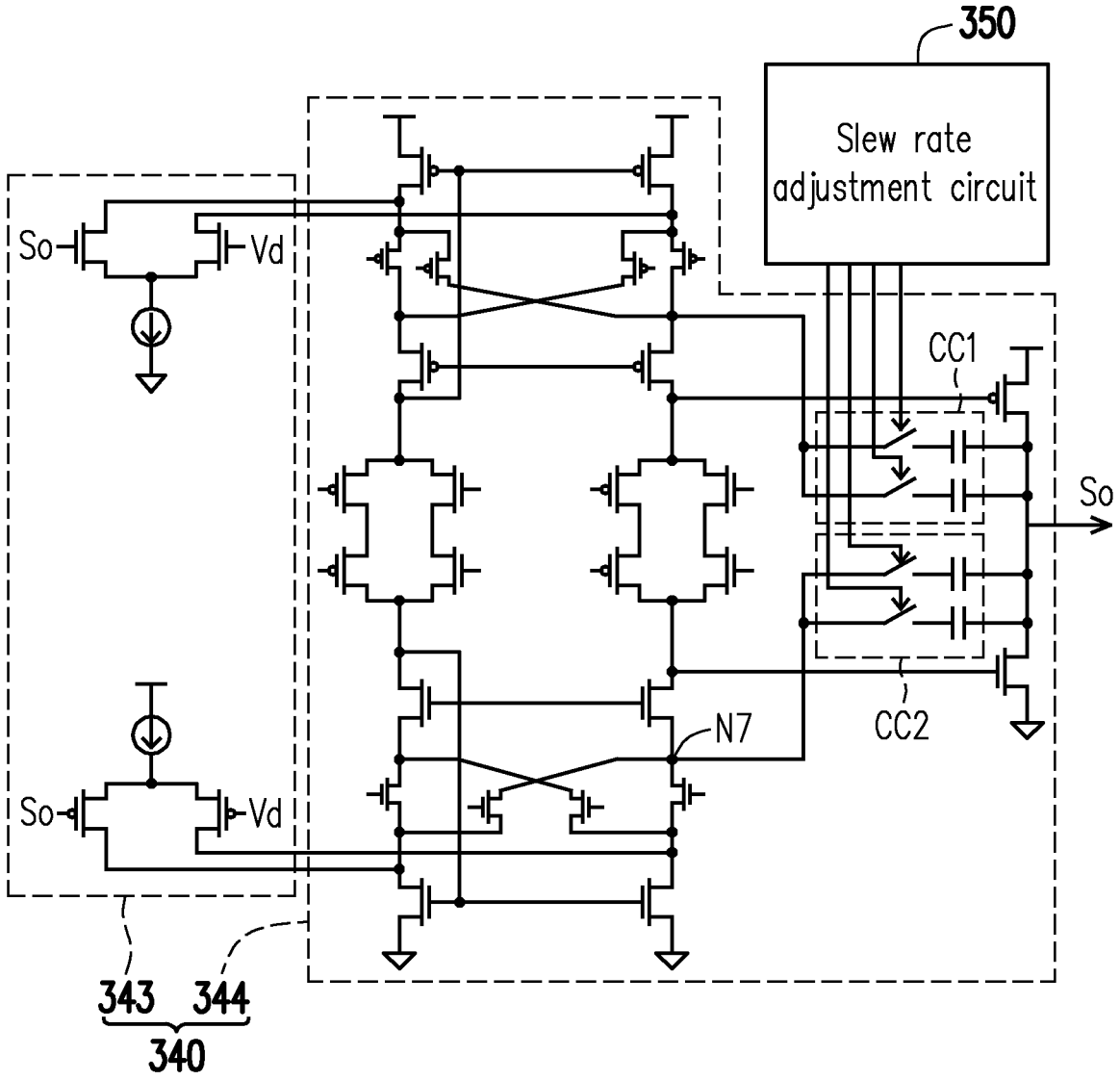
FIG. 7 is a schematic circuit diagram illustrating the output buffer shown in FIG. 3 according to another embodiment of the disclosure.

FIG. 7 is a schematic circuit diagram illustrating the output buffer 340 shown in FIG. 3 according to another embodiment of the disclosure. The output buffer 340 shown in FIG. 7 includes an input stage 343 and an output stage 344. The slew rate adjustment circuit 350 may adjust/set capacitance configurations of compensation capacitors CC1 and CC2 in the output stage 344, as shown in FIG. 7. When the slew rate adjustment circuit 350 determines that the slew rate of the output signal So needs to be increased, the slew rate adjustment circuit 350 may select a small capacitance of the compensation capacitors CS1 and CS2. When the slew rate adjustment circuit 350 determines that the slew rate of the output signal So needs to be reduced, the slew rate adjustment circuit 350 may select a large capacitance of the compensation capacitors CS1 and CS2. Therefore, based on the adjustment/setting of the capacitance configurations of the compensation capacitors CC1 and CC2 in the output stage 344, the rising time Tr and the falling time Tf of the output buffer 340 can be adjusted independently.

Figure 8:
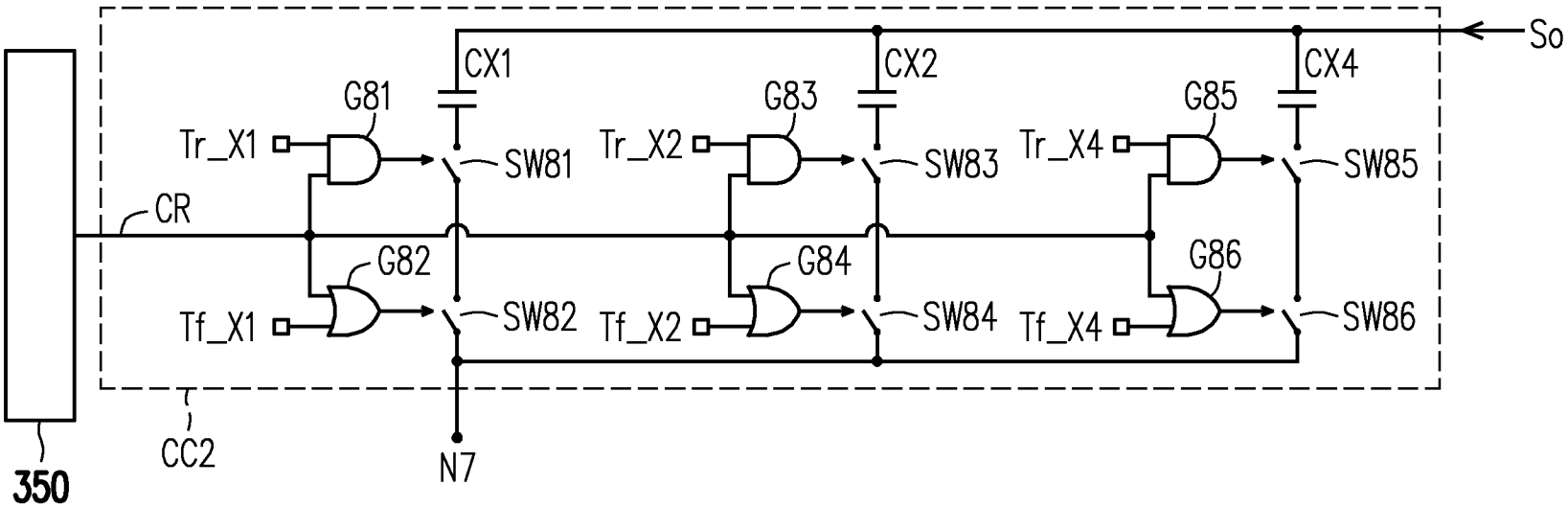
FIG. 8 is another schematic circuit diagram illustrating a compensation capacitor in an output stage shown in FIG. 7 according to another embodiment of the disclosure.

FIG. 8 is another schematic circuit diagram illustrating the compensation capacitor CC2 in the output stage 344 shown in FIG. 7 according to another embodiment of the disclosure. The compensation capacitor CC1 in the input stage 341 shown in FIG. 7 may be understood by analogy with reference to the related description of the compensation capacitor CC2. The compensation capacitor CC2 shown in FIG. 8 includes a single capacitor CX1, a double capacitor CX2, a quadruple capacitor CX4, a switch SW81, a switch SW82, a switch SW83, a switch SW84, a switch SW85, a switch SW86, an AND gate G81, an AND gate G83, an AND gate G85, an OR gate G82, an OR gate G84 and an OR gate G86.

A first terminal of each of the capacitors CX1, CX2 and CX4 is coupled to an output terminal of the output stage 344 to receive the output signal So. A first terminal of the switch SW81 is coupled to a second terminal of the capacitor CX1. A first terminal of the switch SW82 is coupled to a second terminal of the switch SW81. A second terminal of the switch SW82 is coupled to a node N7 in the input stage 341 shown in FIG. 7. A first terminal of the switch SW83 is coupled to a second terminal of the capacitor CX2. A first terminal of the switch SW84 is coupled to a second terminal of the switch SW83. A second terminal of the switch SW84 is coupled to the node N7. A first terminal of the switch SW85 is coupled to a second terminal of the capacitor CX4. A first terminal of the switch SW86 is coupled to a second terminal of the switch SW85. A second terminal of the switch SW86 is coupled to the node N7.

A first input terminal of the AND gate G81 receives the first bit Tr_X1 of the rising edge slew rate parameter. An output terminal of the AND gate G81 is coupled to a control terminal of the switch SW81. A first input terminal of the AND gate G83 receives the second bit Tr_X2 of the rising edge slew rate parameter. An output terminal of the AND gate G83 is coupled to a control terminal of the switch SW83. A first input terminal of the AND gate G85 receives the third bit Tr_X4 of the rising edge slew rate parameter. An output terminal of the AND gate G85 is coupled to a control terminal of the switch SW85. A first input terminal of the OR gate G82 receives the first bit Tf_X1 of the falling edge slew rate parameter. An output terminal of the OR gate G82 is coupled to a control terminal of the switch SW82. A first input terminal of the OR gate G84 receives the second bit Tf_X2 of the falling edge slew rate parameter. An output terminal of the OR gate G84 is coupled to a control terminal of the switch SW84. A first input terminal of the OR gate G86 receives the third bit Tf_X4 of the falling edge slew rate parameter. An output terminal of the OR gate G86 is coupled to a control terminal of the switch SW86.

In some embodiments, the rising edge slew rate parameters Tr_X1 to Tr_X4 and the falling edge slew rate parameters Tf_X1 to Tf_X4 may be local parameters. In other embodiments, the rising edge slew rate parameters Tr_X1 to Tr_X4 and the falling edge slew rate parameters Tf_X1 to Tf_X4 may be global parameters. The rising edge slew rate parameters Tr_X1 to Tr_X4 may be stored in one parameter register, and the falling edge slew rate parameters Tf_X1 to Tf_X4 may be stored in another parameter register. In some embodiments, the slew rate adjustment circuit 350 may provide the rising edge slew rate parameters Tr_X1 to Tr_X4 and the falling edge slew rate parameters Tf_X1 to Tf_X4 to the AND gate G81, the AND gate G83, the AND gate G85, the OR gate G82, the OR gate G84 and the OR gate G86. In other embodiments, the rising edge slew rate parameters Tr_X1 to Tr_X4 and the falling edge slew rate parameters Tf_X1 to Tf_X4 may be provided by other circuits/elements (not shown).

The slew rate adjustment circuit 350 is coupled to a second input terminal of the AND gate G81, a second input terminal of the AND gate G83, a second input terminal of the AND gate G85, a second input terminal of the OR gate G82, a second input terminal of the OR gate G84 and a second input terminal of the OR gate G86, so as to provide the comparison result CR of the current sub-pixel data Pixc and the next sub-pixel data Pixn. It is assumed herein that the comparison result CR with a high logic level indicates "the output signal So will have a rising edge," and the comparison result CR with a low logic level indicates "the output signal So will have a falling edge."

Figure 9:
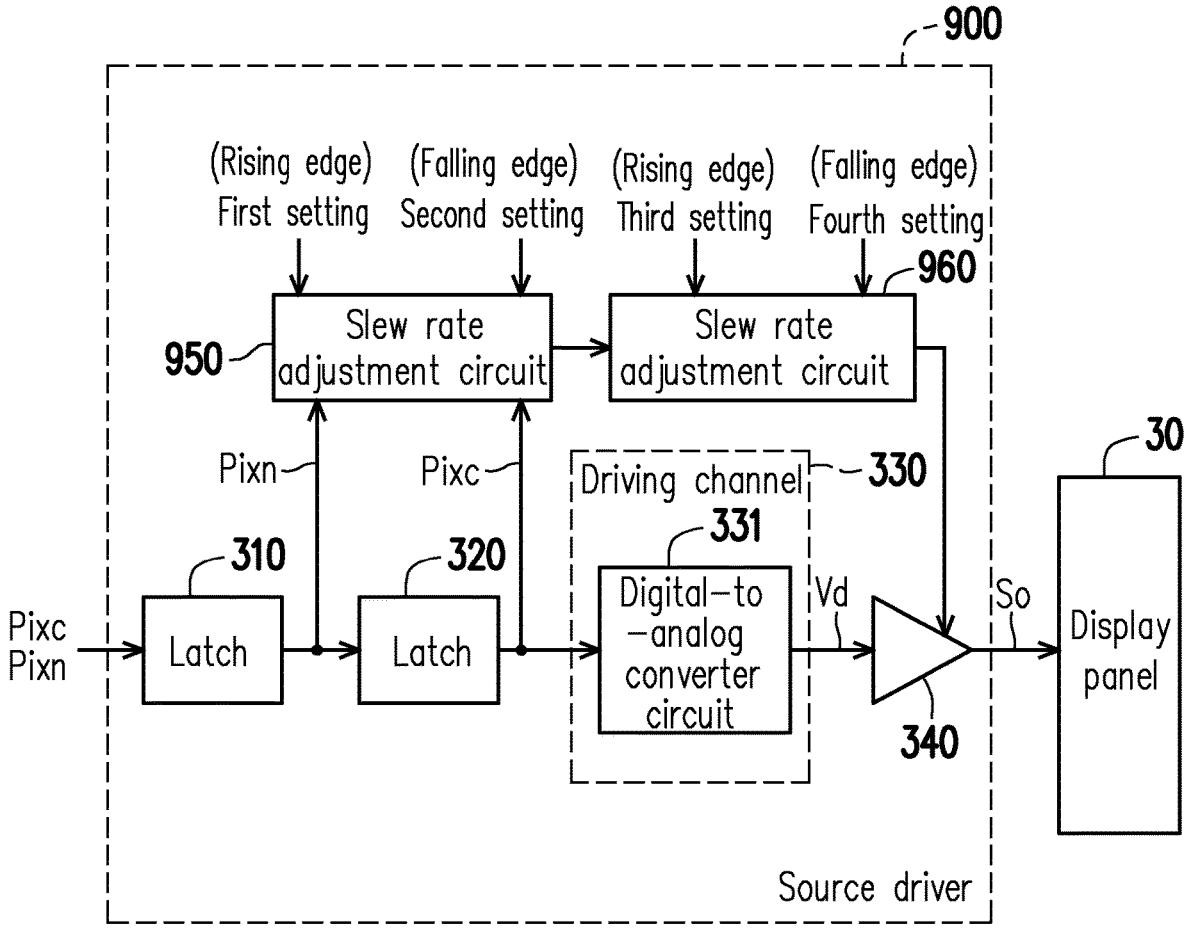
FIG. 9 is a schematic circuit block diagram of a source driver according to another embodiment of the disclosure.

FIG. 9 is a schematic circuit block diagram of a source driver 900 according to another embodiment of the disclosure. The source driver 900 is adapted to drive the display panel 30. The source driver 900 shown in FIG. 9 includes the latch 310, the latch 320, the driving channel 330, the output buffer 340, a slew rate adjustment circuit 950, and a slew rate adjustment circuit 960. The latch 310, the latch 320, the driving channel 330, the output buffer 340, the slew rate adjustment circuit 950 and the display panel 30 may be understood with reference to the related description of the latch 310, the latch 320, the driving channel 330, the output buffer 340, the slew rate adjustment circuit 350 and the display panel 30 shown in FIG. 3, and therefore details thereof will not be repeated. The slew rate adjustment circuit 950 may judge whether the slew rate to be adjusted is at the rising edge or the falling edge of the output signal So. Based on a notification from the slew rate adjustment circuit 950, the slew rate adjustment circuit 960 may judge whether the slew rate to be adjusted is at the rising edge or the falling edge of the output signal So.

The slew rate adjustment circuit 960 may dynamically adjust the slew rate of the rising edge of the output signal So using a third setting and may dynamically adjust the slew rate of the falling edge of the output signal So using a fourth setting independent of the third setting, such that the adjustment to the slew rate of the rising edge of the output signal So is independent of the adjustment to the slew rate of the falling edge of the output signal So. The adjustment by the slew rate adjustment circuit 950 and the adjustment by the slew rate adjustment circuit 960 are of different resolutions. For example, the slew rate adjustment circuit 950 may coarsely adjust the slew rate of the output signal So based on the first setting and the second setting, and the slew rate adjustment circuit 960 may finely adjust the slew rate of the output signal So based on the third setting and the fourth setting.

The third setting and the fourth setting may be two configuration parameters (for example, a rising time parameter and a falling time parameter) independent of each other. These two configuration parameters may be preset according to actual application scenarios. Other control circuits (for example, a timing controller, an application processor, or other processing circuit, not shown) may dynamically provide these two configuration parameters to (or set them in) the slew rate adjustment circuit 960. Since the two configuration parameters are adjusted (or set) independently of each other, the adjustment to the slew rate (for example, the rising time Tr1) of the rising edge of the output signal So may be independent of the adjustment to the slew rate (for example, the falling time Tf2) of the falling edge of the output signal So.

The number of the slew rate adjustment circuit 960 may be determined according to actual condition. For example, in some embodiments, the output buffer of each driving channel of the source driver 900 may include a dedicated slew rate adjustment circuit 960 so as to make a local parameter adjustment. In other embodiments, all the driving channels of the source driver 900 may be divided into multiple channel groups, and the output buffers of each of the channel groups may include one slew rate adjustment circuit 960. In still other embodiments, the output buffers of all the driving channels of the source driver 900 may share one slew rate adjustment circuit 960.

Figure 10:
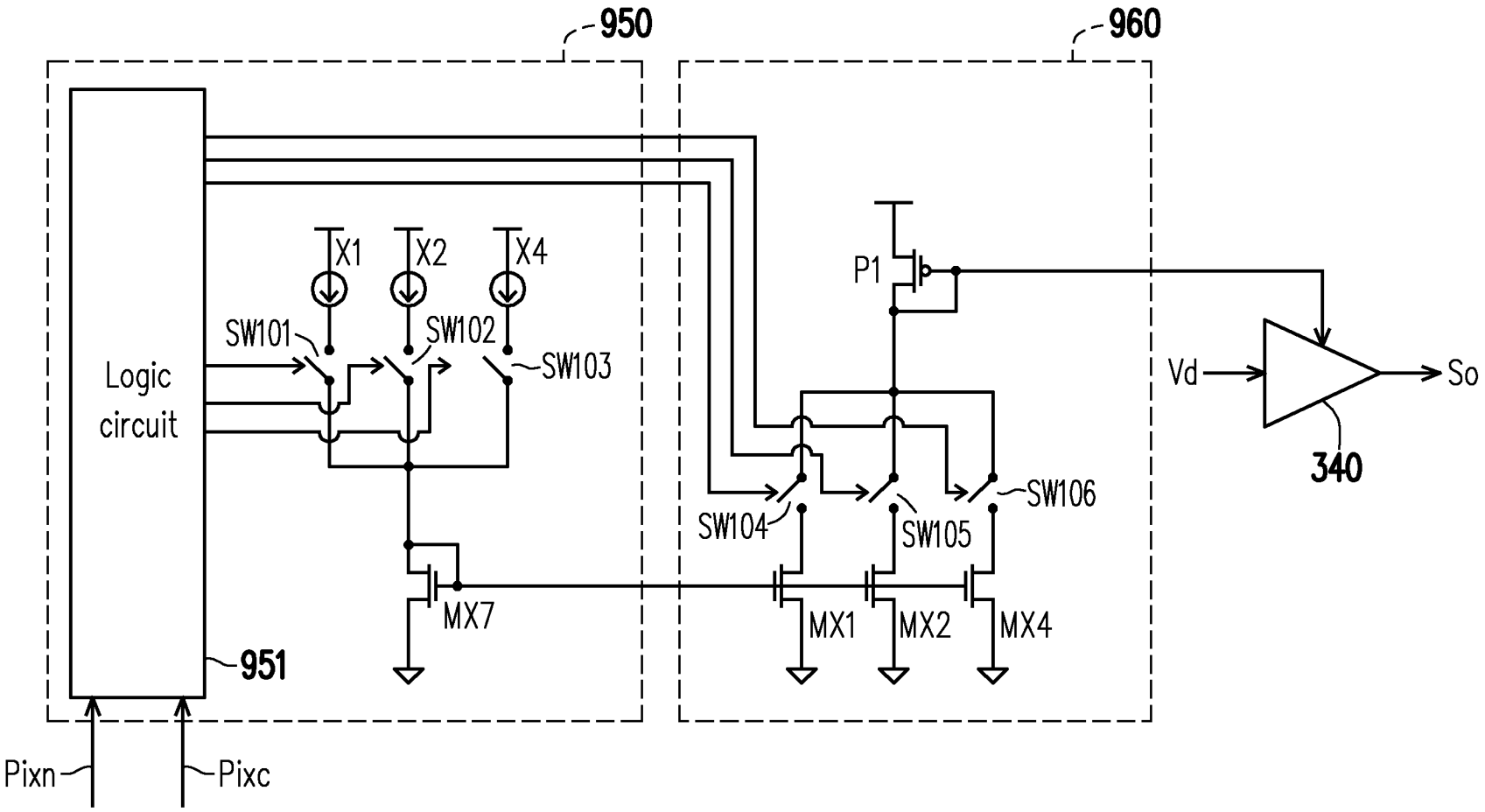
FIG. 10 is a schematic circuit diagram illustrating a slew rate adjustment circuit shown in FIG. 9 according to an embodiment of the disclosure.

FIG. 10 is a schematic circuit diagram illustrating the slew rate adjustment circuits 950 and 960 shown in FIG. 9 according to an embodiment of the disclosure. The slew rate adjustment circuit 950 shown in FIG. 10 includes a logic circuit 951, the single current source X1, the double current source X2, the quadruple current source X4, a switch SW101, a switch SW102, a switch SW103, and a transistor MX7. The logic circuit 951 may judge whether the slew rate to be adjusted is at the rising edge or the falling edge of the output signal So. The logic circuit 951 may output the first setting or the second setting to control terminals of the switches SW101 to SW103. A first terminal of the switch SW101 is coupled to the current source X1. A first terminal of the switch SW102 is coupled to the current source X2. A first terminal of the switch SW103 is coupled to the current source X4. A gate and a drain of the transistor MX7 are coupled to a second terminal of each of the switches SW101 to SW103.

The slew rate adjustment circuit 960 shown in FIG. 10 includes a transistor P1, a switch SW104, a switch SW105, a switch SW106, a single transistor MX1, a double transistor MX2, and a quadruple transistor MX4. A gate of each of the transistors MX1, MX2, and MX4 is coupled to a gate of the transistor MX7. A first terminal of the switch SW104 is coupled to a drain of the transistor MX1. A first terminal of the switch SW105 is coupled to a drain of the transistor MX2. A first terminal of the switch SW106 is coupled to a drain of the transistor MX4. The logic circuit 951 may output the third setting or the fourth setting to control terminals of the switches SW104 to SW106. A gate and a drain of the transistor P1 are coupled to second terminals of the switches SW104 to SW106. The gate of the transistor P1 is further coupled to a tail current source of the output buffer 340.

When the logic circuit 951 determines that the slew rate to be adjusted is at the rising edge of the output signal So, the logic circuit 951 may output the first setting to the switches SW101 to SW103 to coarsely adjust the slew rate of the rising edge of the output signal So, and the logic circuit 951 may output the third setting to the switches SW104 to SW106 to finely adjust the slew rate of the rising edge of the output signal So. When the logic circuit 951 determines that the slew rate to be adjusted is at the falling edge of the output signal So, the logic circuit 951 may output the second setting to the switches SW101 to SW103 to coarsely adjust the slew rate of the falling edge of the output signal So, and the logic circuit 951 may output the fourth setting to the switches SW104 to SW106 to finely adjust the slew rate of the falling edge of the output signal So.

Figure 11:
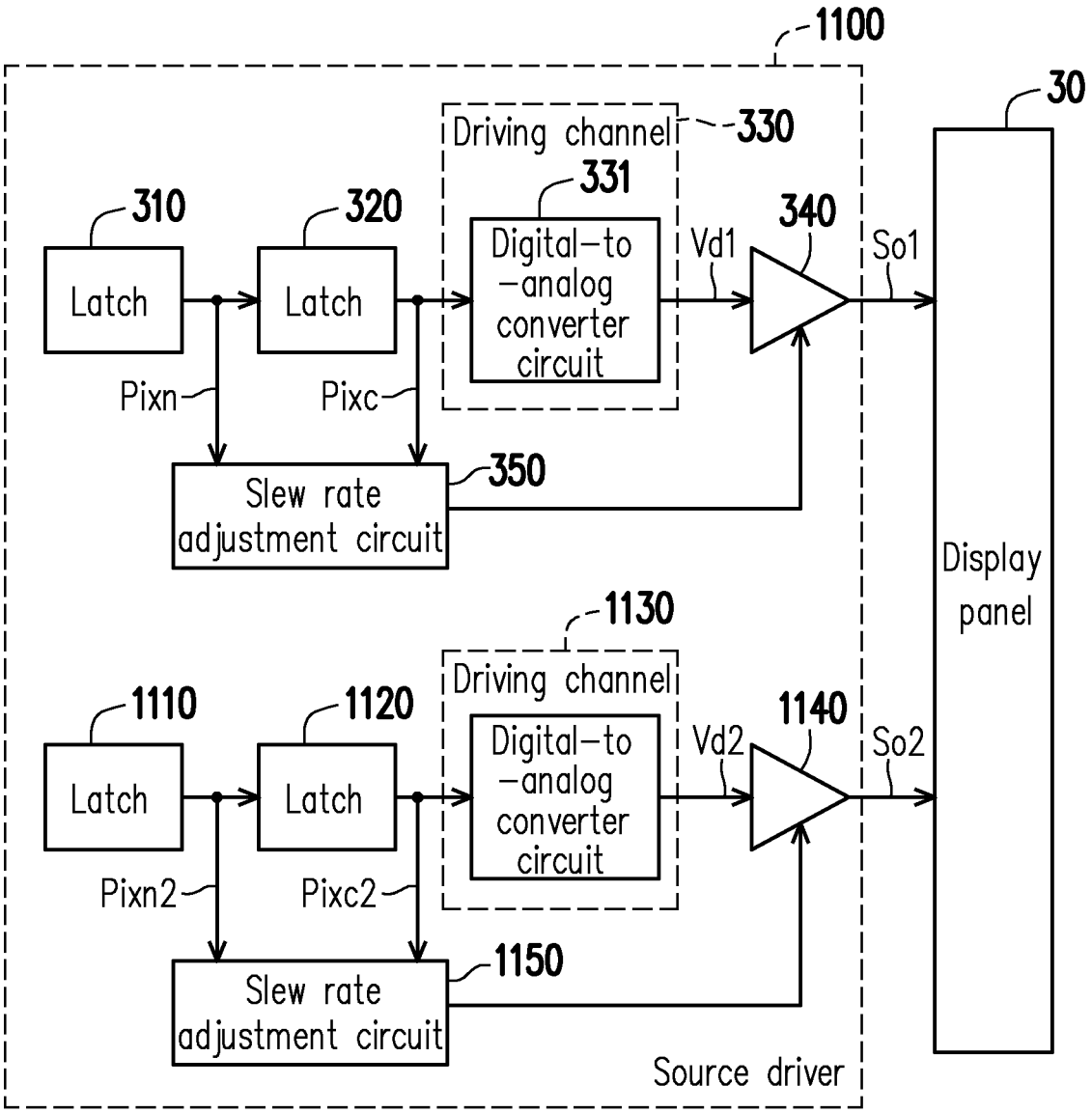
FIG. 11 is a schematic circuit block diagram of a source driver according to still another embodiment of the disclosure.

FIG. 11 is a schematic circuit block diagram of a source driver 1100 according to still another embodiment of the disclosure. The source driver 1100 is adapted to drive the display panel 30. The source driver 1100 shown in FIG. 11 includes the latch 310, the latch 320, the driving channel 330, the output buffer 340, the slew rate adjustment circuit 350, a latch 1110, a latch 1120, a driving channel 1130, an output buffer 1140, and a slew rate adjustment circuit 1150. The latch 310 and the latch 1110 shown in FIG. 11 may be understood with reference to the related description of the latch 310 shown in FIG. 3. The latch 320 and the latch 1120 shown in FIG. 11 may be understood with reference to the related description of the latch 320 shown in FIG. 3. The driving channel 330 and the driving channel 1130 shown in FIG. 11 may be understood with reference to the related description of the driving channel 330 shown in FIG. 3. The output buffer 340 and the output buffer 1140 shown in FIG. 11 may be understood with reference to the related description of the output buffer 340 shown in FIG. 3. The slew rate adjustment circuit 350 and the slew rate adjustment circuit 1150 shown in FIG. 11 may be understood with reference to the related description of the slew rate adjustment circuit 350 shown in FIG. 3. Therefore, details thereof will not be repeated.

The input terminal of the output buffer 340 may receive a driving voltage Vd1. The output terminal of the output buffer 340 may provide an output signal So1 adapted to drive the display panel 30. An input terminal of the output buffer 1140 may receive a driving voltage Vd2. An output terminal of the output buffer 1140 may provide an output signal So2 adapted to drive the display panel 30. The output buffer 340 and the output buffer 1140 are adapted to drive different data lines of the display panel 30. In other embodiments, the slew rate adjustment circuits 350 and 1150 may perform coarse and fine adjustment operations on the output buffers 340 and 1140 (see the related description of the slew rate adjustment circuits 950 and 960 shown in FIG. 9 or FIG. 10 for details).

The slew rate adjustment circuit 350 may judge whether the slew rate to be adjusted is at a rising edge or a falling edge of the output signal So1 output by the output buffer 340. When the slew rate adjustment circuit 350 determines that the output signal So1 will have a rising edge, the slew rate adjustment circuit 350 may dynamically adjust the slew rate of the rising edge of the output signal So1 using the first setting. When the slew rate adjustment circuit 350 determines that the output signal So1 will have a falling edge, the slew rate adjustment circuit 350 may dynamically adjust the slew rate of the falling edge of the output signal So1 using the second setting (which is independent of the first setting). Based on the dynamic adjustment by the slew rate adjustment circuit 350, that is, based on the first setting and the second setting, an adjustment direction of the slew rate of the rising edge of the output signal So1 may be different from an adjustment direction of the slew rate of the falling edge of the output signal So1.

The adjustment by the slew rate adjustment circuit 350 may be independent of the adjustment by the slew rate adjustment circuit 1150. The slew rate adjustment circuit 1150 is coupled to an output terminal of the latch 1110 to receive current sub-pixel data Pixc2. The slew rate adjustment circuit 1150 is coupled to an output terminal of the latch 1120 to receive next sub-pixel data Pixn2 that follows the current sub-pixel data Pixc2. Based on the current sub-pixel data Pixc2 and the next sub-pixel data Pixn2, the slew rate adjustment circuit 1150 may adjust a slew rate of the output signal So2.

For example, in accordance with a relationship between the current sub-pixel data Pixc2 and the next sub-pixel data Pixn2, the slew rate adjustment circuit 1150 may judge whether the slew rate to be adjusted is at a rising edge or a falling edge of the output signal So2 output by the output buffer 1140. When the slew rate adjustment circuit 1150 determines that the output signal So2 will have a rising edge, the slew rate adjustment circuit 1150 may dynamically adjust the slew rate of the rising edge of the output signal So2 using the third setting. When the slew rate adjustment circuit 1150 determines that the output signal So2 will have a falling edge, the slew rate adjustment circuit 1150 may dynamically adjust the slew rate of the falling edge of the output signal So2 using the fourth setting (which is independent of the third setting). Based on the dynamic adjustment by the slew rate adjustment circuit 1150, that is, based on the third setting and the fourth setting, an adjustment direction of the slew rate of the rising edge of the output signal So2 may be different from an adjustment direction of the slew rate of the falling edge of the output signal So2.

The third setting and the fourth setting may be two configuration parameters (for example, a rising time parameter and a falling time parameter) independent of each other. These two configuration parameters may be preset according to actual application scenarios. Other control circuits (for example, a timing controller, an application processor, or other processing circuit, not shown) may dynamically provide these two configuration parameters to (or set them in) the slew rate adjustment circuit 1150. Since the two configuration parameters are adjusted (or set) independently of each other, the adjustment to the slew rate (for example, the rising time Tr1) of the rising edge of the output signal So2 may be independent of the adjustment to the slew rate (for example, the falling time Tf2) of the falling edge of the output signal So2.

In accordance with the relationship between the current sub-pixel data Pixc2 and the next sub-pixel data Pixn2, the slew rate adjustment circuit 1150 may independently set (adjust) the slew rate of the rising edge of the output signal So2 and the slew rate of the falling edge of the output signal So2. In accordance with the relationship between the current sub-pixel data Pixc and the next sub-pixel data Pixn, the slew rate adjustment circuit 350 may independently set (adjust) the slew rate of the rising edge of the output signal So1 and the slew rate of the falling edge of the output signal So1. Therefore, the slew rate of the rising edge of the output signal So1 may be symmetrical to the slew rate of the falling edge of the output signal So2, and the slew rate of the falling edge of the output signal So1 may be symmetrical to the slew rate of the rising edge of the output signal So2.

Figure 12:
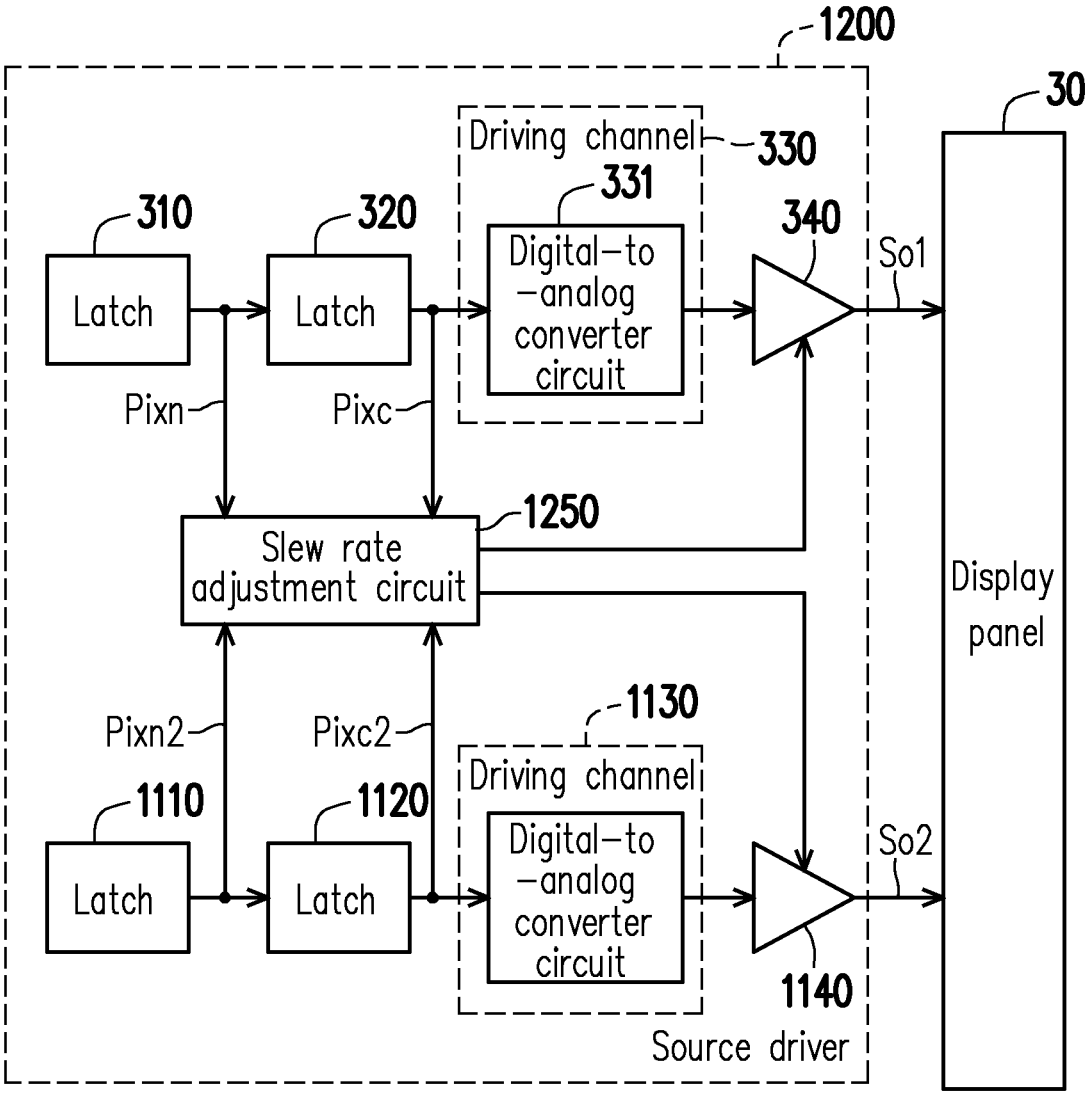
FIG. 12 is a schematic circuit block diagram of a source driver according to yet still another embodiment of the disclosure.

FIG. 12 is a schematic circuit block diagram of a source driver 1200 according to yet still another embodiment of the disclosure. The source driver 1200 is adapted to drive the display panel 30. The source driver 1200 shown in FIG. 12 includes the latch 310, the latch 320, the driving channel 330, the output buffer 340, the latch 1110, the latch 1120, the driving channel 1130, the output buffer 1140, and a slew rate adjustment circuit 1250. The latch 310 and the latch 1110 shown in FIG. 12 may be understood with reference to the related description of the latch 310 and the latch 1110 shown in FIG. 11. The latch 320 and the latch 1120 shown in FIG. 12 may be understood with reference to the related description of the latch 320 and the latch 1120 shown in FIG. 11. The driving channel 330 and the driving channel 1130 shown in FIG. 12 may be understood with reference to the related description of the driving channel 330 and the driving channel 1130 shown in FIG. 11. The output buffer 340 and the output buffer 1140 shown in FIG. 12 may be understood with reference to the related description of the output buffer 340 and the output buffer 1140 shown in FIG. 11. Therefore, details thereof will not be repeated.

The slew rate adjustment circuit 1250 shown in FIG. 12 may be understood with reference to the related description of the slew rate adjustment circuit 350 shown in FIG. 3. A difference from the slew rate adjustment circuit 350 shown in FIG. 3 is that, the slew rate adjustment circuit 1250 shown in FIG. 12 is coupled to the output terminal of the latch 310 and the output terminal of the latch 320 to receive the current sub-pixel data Pixc and the next sub-pixel data Pixn that follows the current sub-pixel data Pixc, respectively, and is coupled to the output terminal of the latch 1110 and the output terminal of the latch 1120 to receive the current sub-pixel data Pixc2 and the next sub-pixel data Pixn2 that follows the current sub-pixel data Pixc2, respectively. Based on the current sub-pixel data Pixc and the next sub-pixel data Pixn, the slew rate adjustment circuit 1250 may adjust a slew rate of the output signal So1. Based on the current sub-pixel data Pixc2 and the next sub-pixel data Pixn2, the slew rate adjustment circuit 1250 may further adjust a slew rate of the output signal So2.

The slew rate adjustment circuit 1250 may dynamically adjust the slew rate of the rising edge of the output signal So2 of the output buffer 1140 using the third setting and may dynamically adjust the slew rate of the falling edge of the output signal So2 using the fourth setting independent of the third setting, such that the adjustment to the slew rate of the rising edge of the output signal So2 is independent of the adjustment to the slew rate of the falling edge of the output signal So2. That is, the slew rate adjustment circuit 1250 may judge whether the slew rate to be adjusted is at the rising edge or the falling edge of the output signal So1, and whether the slew rate to be adjusted is at the rising edge or the falling edge of the output signal So2. The slew rate adjustment circuit 1250 may perform the above judgment in accordance with the relationship between the current sub-pixel data Pixc2 and the next sub-pixel data Pixn2. In other embodiments, the slew rate adjustment circuit 1250 may perform coarse and fine adjustment operations on the output buffers 340 and 1140 (see the related description of the slew rate adjustment circuits 950 and 960 shown in FIG. 9 or FIG. 10 for details).

Figure 13:
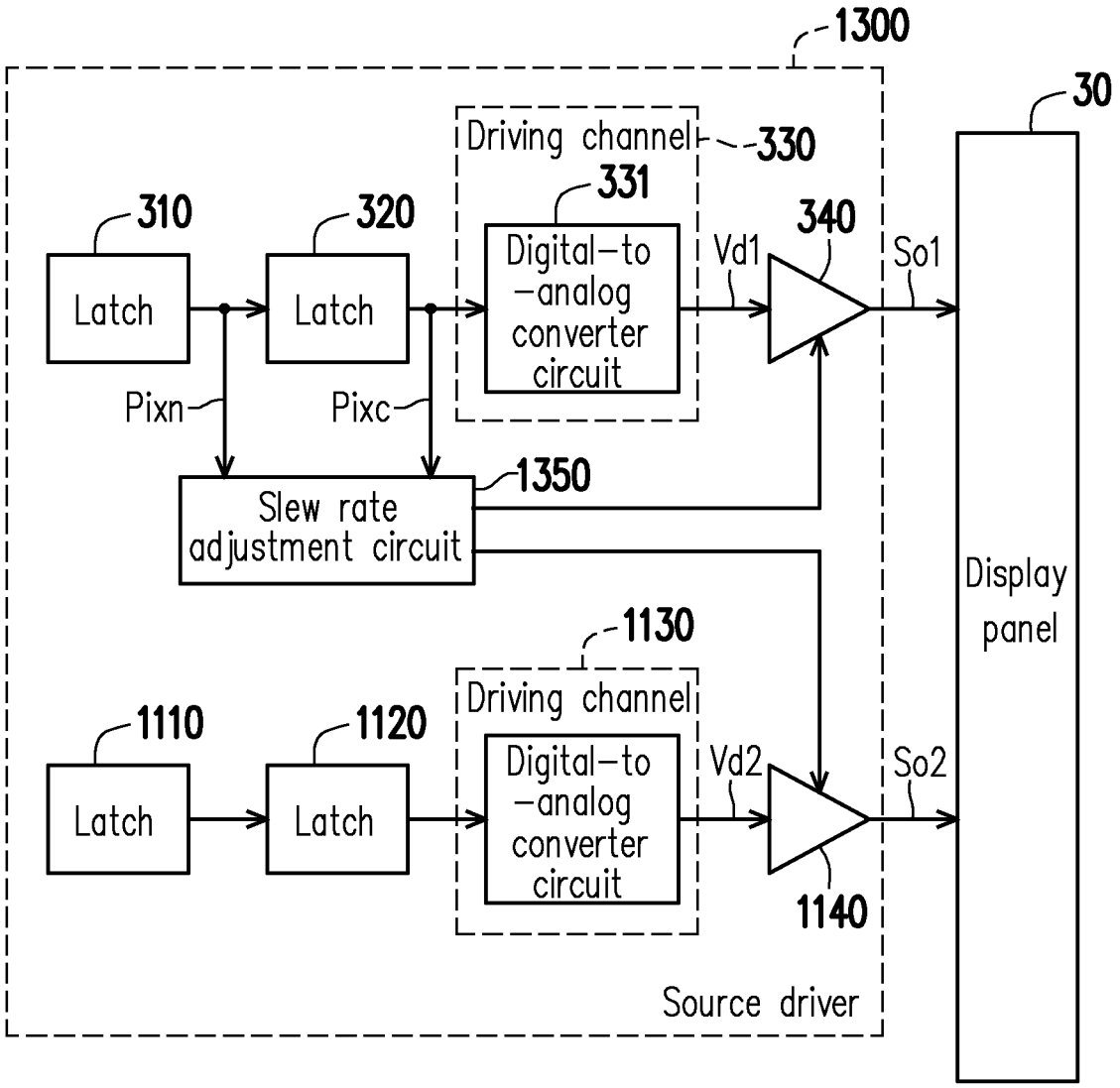
FIG. 13 is a schematic circuit block diagram of a source driver according to a further embodiment of the disclosure.

FIG. 13 is a schematic circuit block diagram of a source driver 1300 according to a further embodiment of the disclosure. The source driver 1300 is adapted to drive the display panel 30. The source driver 1300 shown in FIG. 13 includes the latch 310, the latch 320, the driving channel 330, the output buffer 340, the latch 1110, the latch 1120, the driving channel 1130, the output buffer 1140, and a slew rate adjustment circuit 1350. The latch 310 and the latch 1110 shown in FIG. 13 may be understood with reference to the related description of the latch 310 and the latch 1110 shown in FIG. 11. The latch 320 and the latch 1120 shown in FIG. 13 may be understood with reference to the related description of the latch 320 and the latch 1120 shown in FIG. 11. The driving channel 330 and the driving channel 1130 shown in FIG. 13 may be understood with reference to the related description of the driving channel 330 and the driving channel 1130 shown in FIG. 11. The output buffer 340 and the output buffer 1140 shown in FIG. 13 may be understood with reference to the related description of the output buffer 340 and the output buffer 1140 shown in FIG. 11. Therefore, details thereof will not be repeated.

The slew rate adjustment circuit 1350 shown in FIG. 13 may be understood with reference to the related description of the slew rate adjustment circuit 350 shown in FIG. 3. A difference from the slew rate adjustment circuit 350 shown in FIG. 3 is that, the slew rate adjustment circuit 1350 shown in FIG. 13 may further make a judgment in accordance with the relationship between the current sub-pixel data Pixc and the next sub-pixel data Pixn, such that the adjustment to the slew rate of the rising edge of the output signal So2 is independent of the adjustment to the slew rate of the falling edge of the output signal So2. The slew rate adjustment circuit 1350 shown in FIG. 13 is coupled to the output terminal of the latch 310 and the output terminal of the latch 320 to receive the current sub-pixel data Pixc and the next sub-pixel data Pixn that follows the current sub-pixel data Pixc, respectively. Based on the current sub-pixel data Pixc and the next sub-pixel data Pixn, the slew rate adjustment circuit 1350 may adjust the slew rate of each of the output signals So1 and So2. In other embodiments, the slew rate adjustment circuit 1350 may perform coarse and fine adjustment operations on the output buffers 340 and 1140 (see the related description of the slew rate adjustment circuits 950 and 960 shown in FIG. 9 or FIG. 10 for details).

The slew rate adjustment circuits 350, 950, 960, 1150, 1250 and/or 1350 may be implemented in hardware, firmware, software (i.e., program), or a combination of the above three.

In terms of hardware, a block of the slew rate adjustment circuits 350, 950, 960, 1150, 1250 and/or 1350 may be implemented in a logic circuit on an integrated circuit. Related functions of the slew rate adjustment circuits 350, 950, 960, 1150, 1250 and/or 1350 may be implemented as hardware using hardware description languages (for example, Verilog HDL or VHDL) or other suitable programming languages. For example, the related functions of the slew rate adjustment circuits 350, 950, 960, 1150, 1250 and/or 1350 may be implemented in various logic blocks, modules and circuits in one or more controllers, microcontrollers, microprocessors, application-specific integrated circuits (ASICs), digital signal processors (DSPs), field programmable gate arrays (FPGAs) and/or other processing units.

In terms of software and/or firmware, the related functions of the slew rate adjustment circuits 350, 950, 960, 1150, 1250 and/or 1350 may be implemented as programming codes. For example, the slew rate adjustment circuits 350, 950, 960, 1150, 1250 and/or 1350 is implemented using a general programming language (for example, C, C++ or an assembly language) or other suitable programming language. The programming codes may be stored in a non-transitory computer readable medium. In some embodiments, the non-transitory computer readable medium includes, for example, a read only memory (ROM), and/or a storage device. A controller, microcontroller or microprocessor may read and execute the programming codes from the non-transitory computer readable medium, thereby realizing the related functions of the slew rate adjustment circuits 350, 950, 960, 1150, 1250 and/or 1350.

In summary, the source driver according to the above embodiments may dynamically adjust the slew rates of the rising edge and the falling edge of the output signal using different settings, such that the adjustment to the slew rate of the rising edge is independent of the adjustment to the slew rate of the falling edge. Therefore, in some embodiments, the source driver may make it possible that the output signals of different output buffers are symmetrical to each other.

Although the disclosure has been described with reference to embodiments thereof, it will be apparent to one of ordinary skill in the art that modifications and variations may be made without departing from the spirit of the disclosure. Accordingly, the scope of the disclosure will be defined by the attached claims.

What is claimed is:

1. A source driver adapted to drive a display panel, the source driver comprising:

a first output buffer having an input terminal to receive a first driving voltage and an output terminal to output a first output signal to drive the display panel; and a first slew rate adjustment circuit to dynamically adjust a slew rate of a rising edge of the first output signal according to a first setting and to dynamically adjust a slew rate of a falling edge of the first output signal according to a second setting independent of the first setting, wherein the first slew rate adjustment circuit performs a judgment in accordance with a relationship between first current sub-pixel data and first next sub-pixel data that follows the first current sub-pixel data.

2. The source driver according to claim 1, wherein, based on the dynamic adjustment by the first slew rate adjustment circuit, an adjustment direction of the slew rate of the rising edge of the first output signal is different from an adjustment direction of the slew rate of the falling edge of the first output signal.

3. The source driver according to claim 1, wherein the first slew rate adjustment circuit determines whether a slew rate to be adjusted is at the rising edge or the falling edge of the first output signal.

4. The source driver according to claim 1, further comprising:

a first driving channel having an output terminal coupled to the input terminal of the first output buffer to output the first driving voltage, and convert the first current sub-pixel data into the first driving voltage;

a first latch, having an input terminal to sequentially receive the first current sub-pixel data and the first next sub-pixel data; and a second latch having an input terminal coupled to an output terminal of the first latch, wherein the first slew rate adjustment circuit is coupled to the output terminal of the first latch and an output terminal of the second latch to receive the first current sub-pixel data and the first next sub-pixel data respectively, and the adjustment to the slew rate of the first output signal is based on the first current sub-pixel data and the first next sub-pixel data.

5. The source driver according to claim 4, wherein the first driving channel comprises:

a digital-to-analog converter circuit, having an input terminal coupled to the output terminal of the second latch to receive the first current sub-pixel data, wherein an output terminal of the digital-to-analog converter circuit serves as the output terminal of the first driving channel.

6. A source driver adapted to drive a display panel, the source driver comprising:

a first output buffer having an input terminal to receive a first driving voltage and an output terminal to output a first output signal to drive the display panel;

a first slew rate adjustment circuit to dynamically adjust a slew rate of a rising edge of the first output signal according to a first setting and to dynamically adjust a slew rate of a falling edge of the first output signal according to a second setting independent of the first setting; and a second output buffer, having an input terminal configured to receive a second driving voltage, wherein an output terminal of the second output buffer to provide a second output signal adapted to drive the display panel, wherein the first output buffer and the second output buffer drive different data lines of the display panel.

7. The source driver according to claim 6, wherein the first slew rate adjustment circuit further dynamically adjusts a slew rate of a rising edge of the second output signal using a third setting and to dynamically adjust a slew rate of a falling edge of the second output signal using a fourth setting independent of the third setting.

8. The source driver according to claim 7, wherein the first slew rate adjustment circuit determines whether a slew rate to be adjusted is at the rising edge or the falling edge of the second output signal.

9. The source driver according to claim 8, wherein the first slew rate adjustment circuit performs the judgment in accordance with a relationship between second current sub-pixel data and second next sub-pixel data that follows the second current sub-pixel data.

10. The source driver according to claim 8, wherein the first slew rate adjustment circuit performs the judgment in accordance with the relationship between the first current sub-pixel data and the first next sub-pixel data.

11. The source driver according to claim 10, further comprising:

a first driving channel, having an output terminal coupled to the input terminal of the first output buffer to provide the first driving voltage, and convert the first current sub-pixel data into the first driving voltage;

a second driving channel, having an output terminal coupled to the input terminal of the second output buffer to provide the second driving voltage, and convert second current sub-pixel data into the second driving voltage;

a first latch, having an input terminal to sequentially receive the first current sub sub-pixel data and the first next sub-pixel data;

a second latch, having an input terminal coupled to an output terminal of the first latch;

a third latch, having an input terminal to sequentially receive the second current sub-pixel data and second next sub-pixel data that follows the second current sub-pixel data; and a fourth latch, having an input terminal coupled to an output terminal of the third latch, wherein the first slew rate adjustment circuit is coupled to the output terminal of the first latch and an output terminal of the second latch to receive the first current sub-pixel data and the first next sub-pixel data respectively, and the adjustment to the slew rate of the first output signal is based on the first current sub-pixel data and the first next sub-pixel data; and wherein the first slew rate adjustment circuit is coupled to the output terminal of the third latch and an output terminal of the fourth latch to receive the second current sub-pixel data and the second next sub-pixel data respectively, and the adjustment to the slew rate of the second output signal is based on the second current sub-pixel data and the second next sub-pixel data.

12. The source driver according to claim 10, further comprising:

a first driving channel, having an output terminal coupled to the input terminal of the first output buffer to provide the first driving voltage, and convert the first current sub-pixel data into the first driving voltage;

a second driving channel, having an output terminal coupled to the input terminal of the second output buffer to provide the second driving voltage, and converts second current sub-pixel data into the second driving voltage;

a first latch, having an input terminal to sequentially receive the first current sub-pixel data and the first next sub-pixel data; and a second latch, having an input terminal coupled to an output terminal of the first latch, wherein the first slew rate adjustment circuit is coupled to the output terminal of the first latch and an output terminal of the second latch to receive the first current sub-pixel data and the first next sub-pixel data respectively, so as to make the adjustment to the slew rate of each of the first output signal and the second output signal based on the first current sub-pixel data and the first next sub-pixel data.

13. The source driver according to claim 6, further comprising:

a second slew rate adjustment circuit, dynamically adjusts a slew rate of a rising edge of the second output signal using a third setting and dynamically adjusts a slew rate at a falling edge of the second output signal using a fourth setting independent of the third setting, such that the adjustment to the slew rate of the rising edge of the second output signal is independent of the adjustment to the slew rate of the falling edge of the second output signal.

14. The source driver according to claim 13, wherein the second slew rate adjustment circuit determines whether a slew rate to be adjusted is at the rising edge or the falling edge of the second output signal.

15. The source driver according to claim 14, wherein the second slew rate adjustment circuit performs the judgment in accordance with a relationship between second current sub-pixel data and second next sub-pixel data that follows the second current sub-pixel data.

16. The source driver according to claim 13, wherein the adjustment by the first slew rate adjustment circuit is independent of the adjustment by the second slew rate adjustment circuit.

17. The source driver according to claim 16, further comprising:

a first driving channel, having an output terminal coupled to the input terminal of the first output buffer to provide the first driving voltage, and converts the first current sub-pixel data into the first driving voltage;

a second driving channel, having an output terminal coupled to the input terminal of the second output buffer to provide the second driving voltage, and converts second current sub-pixel data into the second driving voltage;

a first latch, having an input terminal to sequentially receive the first current sub-pixel data and the first next sub-pixel data;

a second latch, having an input terminal coupled to an output terminal of the first latch;

a third latch, having an input terminal to sequentially receive the second current sub-pixel data and second next sub-pixel data that follows the second current sub-pixel data; and a fourth latch, having an input terminal coupled to an output terminal of the third latch, wherein the first slew rate adjustment circuit is coupled to the output terminal of the first latch and an output terminal of the second latch to receive the first current sub-pixel data and the first next sub-pixel data respectively, so as to make the adjustment to the slew rate of the first output signal based on the first current sub-pixel data and the first next sub-pixel data; and wherein the second slew rate adjustment circuit is coupled to the output terminal of the third latch and an output terminal of the fourth latch to receive the second current sub-pixel data and the second next sub-pixel data respectively, so as to make the adjustment to the slew rate of the second output signal based on the second current sub-pixel data and the second next sub-pixel data.

18. The source driver according to claim 6, further comprising:

a second slew rate adjustment circuit, dynamically adjusts the slew rate of the rising edge of the first output signal using a third setting and to dynamically adjust the slew rate of the falling edge of the first output signal using a fourth setting independent of the third setting, such that the adjustment to the slew rate of the rising edge of the first output signal is independent of the adjustment to the slew rate of the falling edge of the first output signal, wherein the adjustment by the first slew rate adjustment circuit and the adjustment by the second slew rate adjustment circuit are of different resolutions.

19. The source driver according to claim 18, wherein the second slew rate adjustment circuit determines whether a slew rate to be adjusted is at the rising edge or the falling edge of the first output signal.

20. The source driver according to claim 6, wherein the slew rate of the rising edge of the first output signal is substantially symmetrical to a slew rate of a falling edge of the second output signal, and the slew rate of the falling edge of the first output signal is substantially symmetrical to a slew rate of a rising edge of the second output signal.

21. An operation method of a source driver, comprising:

receiving a first driving voltage by a first output buffer;

outputting, by the first output buffer, a first output signal adapted to drive a display panel; and by a first slew rate adjustment circuit, dynamically adjusting a slew rate of a rising edge of the first output signal according to a first setting and dynamically adjusting a slew rate of a falling edge of the first output signal according to a second setting independent of the first setting, wherein the first slew rate adjustment circuit performs a judgment in accordance with a relationship between first current sub-pixel data and first next sub-pixel data that follows the first current sub-pixel data.

* * * * *